US010285566B2

(12) United States Patent
Fey et al.

(10) Patent No.: US 10,285,566 B2
(45) Date of Patent: May 14, 2019

(54) WASHING ITEM RECEPTACLE FOR A FLAT WASHING ITEM IN A DISHWASHER

(71) Applicant: BSH Hausgeräte GmbH, Munich (DE)

(72) Inventors: Janina Fey, München (DE); Maike Kirschbaum, München (DE); Michael Plank, München (DE); Abigail Potié, München (DE); Anne Schlösser, Feldafing (DE); Andreas Schüssler, München (DE); Cordy Swope, München (DE); Rudolf Voigt, Feldafing (DE); Alf Hackenberg, München (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 15/766,874

(22) PCT Filed: Oct. 6, 2016

(86) PCT No.: PCT/EP2016/073901
§ 371 (c)(1),
(2) Date: Apr. 9, 2018

(87) PCT Pub. No.: WO2017/060365
PCT Pub. Date: Apr. 13, 2017

(65) Prior Publication Data

US 2018/0353050 A1 Dec. 13, 2018

(30) Foreign Application Priority Data

Oct. 9, 2015 (DE) ..... 10 2015 219 620

(51) Int. Cl.
*A47F 7/00* (2006.01)
*A47B 81/04* (2006.01)
(Continued)

(52) U.S. Cl.
CPC ..... *A47L 15/503* (2013.01); *A47B 81/04* (2013.01); *A47F 7/0042* (2013.01);
(Continued)

(58) Field of Classification Search
CPC ..... A47L 15/503; A47L 15/50; A47L 15/502; A47L 15/505; A47L 17/00; A47L 19/00;
(Continued)

(56) References Cited

U.S. PATENT DOCUMENTS 542,734 A * 7/1895 Johnson ..... A47L 19/04
211/41.4
895,211 A * 8/1908 Twitchell ..... A47F 7/0064
211/41.7

(Continued)

FOREIGN PATENT DOCUMENTS

WO 0049935 8/2000

OTHER PUBLICATIONS

International Search Report PCT/EP2016/073901 dated Nov. 29, 2016.

*Primary Examiner* — Jennifer E. Novosad
(74) *Attorney, Agent, or Firm* — Michael E. Tschupp; Andre Pallapies; Brandon G. Braun

(57) ABSTRACT

A washing item receptacle for a flat washing item in a dishwasher, in particular in a domestic dishwasher, includes a base and a support element for supporting the flat washing item. The support element is configured for pivoting between a rest position arranged in a plane of the base and a support position which projects from the plane of the base, and for pivoting from the rest position into the support position by the weight of the flat washing item.

15 Claims, 10 Drawing Sheets

(51) Int. Cl.
*A47L 15/50* (2006.01)
*A47L 19/04* (2006.01)

(52) U.S. Cl.
CPC ..... *A47F 7/0057* (2013.01); *A47F 7/0064* (2013.01); *A47L 15/50* (2013.01); *A47L 15/501* (2013.01); *A47L 15/502* (2013.01); *A47L 19/04* (2013.01)

(58) Field of Classification Search
CPC .. A47L 19/04; A47L 15/0013; A47L 15/0065; A47L 15/0084; A47L 15/0086; A47L 15/0089; A47L 15/14; A47L 15/26; A47L 15/42; A47L 15/48; A47L 15/501; A47L 15/504; A47L 15/507; A47B 81/04; A47B 81/007; B62H 3/06; A47F 7/0042; A47F 7/0057; A47F 7/0064; A47F 5/01; A47F 5/13; A47F 5/10; A47F 5/0037; A47J 47/16; B42F 17/02; A47G 19/08; A47G 19/02; A47G 1/1646
USPC ..... 211/41.8, 41.11, 41.7, 41.9, 181.1, 41.1, 211/41.2, 184, 22, 21, 51, 41.5, 41.6, 211/169, 171
See application file for complete search history.

(56) References Cited

U.S. PATENT DOCUMENTS 1,822,087 A * 9/1931 Feingold ..... A47L 19/04 211/198
1,971,523 A * 8/1934 Feingold ..... A47L 19/04 211/41.5
2,479,118 A * 8/1949 Jenness ..... A47L 19/04 211/195
2,516,088 A * 7/1950 Einhorn ..... A47L 19/04 211/41.5
3,269,548 A * 8/1966 Geiger ..... A47L 15/50 134/165
3,464,566 A * 9/1969 Gilson ..... A47L 15/50 211/41.2
3,752,322 A * 8/1973 Fiocca ..... A47L 15/503 211/41.8
3,785,517 A * 1/1974 Brajkovich ..... B60R 9/10 211/22
4,117,936 A * 10/1978 Dawson ..... A47F 7/148 211/181.1
4,606,464 A * 8/1986 Jordan ..... A47L 15/503 211/184
5,249,590 A * 10/1993 Jacobus ..... A47L 15/505 134/135
5,346,298 A * 9/1994 Headley ..... A47B 81/068 312/190
5,351,837 A * 10/1994 Smith ..... A47L 15/503 211/41.8
5,480,035 A * 1/1996 Smith ..... A47L 15/503 211/168
5,601,195 A * 2/1997 Finola ..... A47L 15/503 211/41.8
5,649,630 A * 7/1997 Remmler ..... A47L 15/503 134/135
5,833,075 A * 11/1998 Czaplinski ..... A47L 19/04 211/41.2
6,003,690 A * 12/1999 Allen ..... G07G 1/0027 210/190
6,170,676 B1 * 1/2001 Patadia ..... A47L 19/04 211/41.3
6,755,309 B1 * 6/2004 Runge ..... B62H 3/04 211/183
6,860,496 B2 * 3/2005 Novak ..... B62B 5/049 211/20
7,128,220 B2 * 10/2006 Baitz ..... G07G 1/0027 211/51
7,231,929 B2 * 6/2007 Landsiedel ..... A47L 15/14 134/135
7,766,175 B2 * 8/2010 Jadhav ..... A47L 15/505 211/41.9
8,042,559 B2 * 10/2011 Choi ..... B08B 3/04 134/137
8,333,284 B2 * 12/2012 Berry ..... A47F 5/0087 211/55
8,985,375 B2 * 3/2015 Kohles ..... A47L 15/503 220/488
9,230,524 B2 * 1/2016 Cortina ..... G10G 5/00
2001/0045401 A1 * 11/2001 Deiss ..... A47L 15/503 211/41.8
2003/0089672 A1 * 5/2003 VanLandingham ... A47L 15/503 211/41.8
2003/0106867 A1 * 6/2003 Caterinacci ..... A47F 1/126 211/40
2006/0108298 A1 * 5/2006 Kim ..... A47L 15/503 211/41.8
2008/0302399 A1 * 12/2008 Classen ..... A47L 15/503 134/157
2010/0116759 A1 * 5/2010 Lindgren ..... A47L 15/505 211/41.8
2011/0025179 A1 * 2/2011 Haltmayer ..... A47L 15/503 312/228.1
2012/0056519 A1 * 3/2012 Woo ..... A47L 15/503 312/228.1
2014/0166599 A1 * 6/2014 Rhodes, II ..... A47L 19/04 211/13.1

* cited by examiner

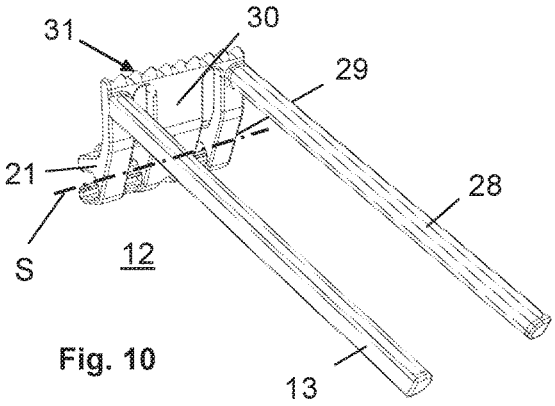
Fig. 10
Fig. 11
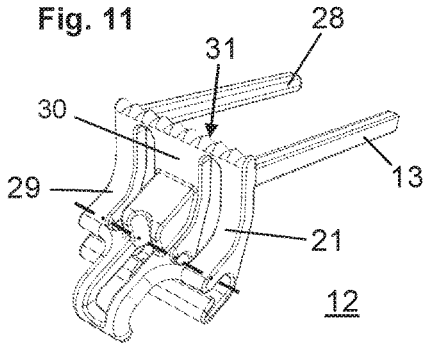
Fig. 12
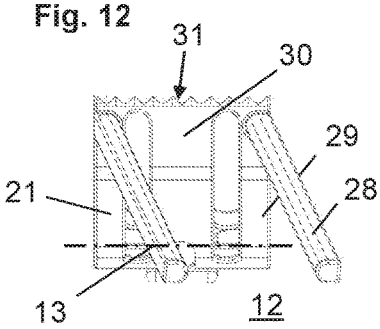
Fig. 13
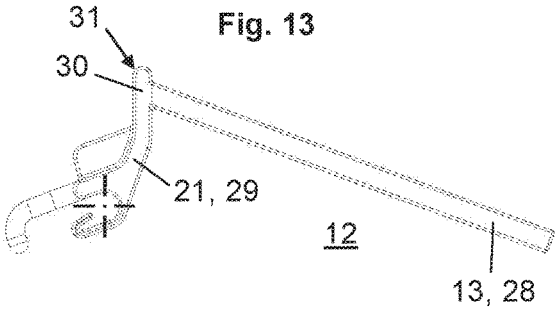
Fig. 14a
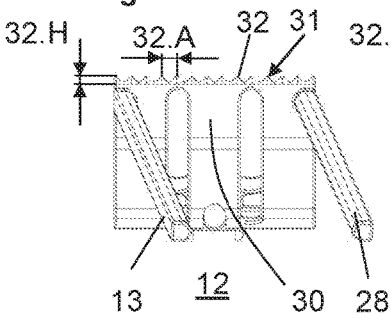
Fig. 14b
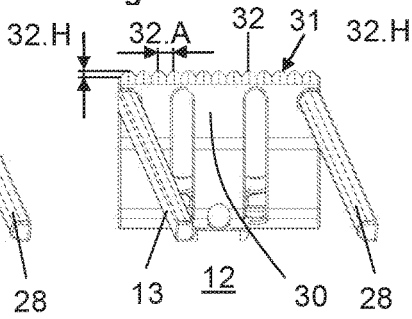
Fig. 14c
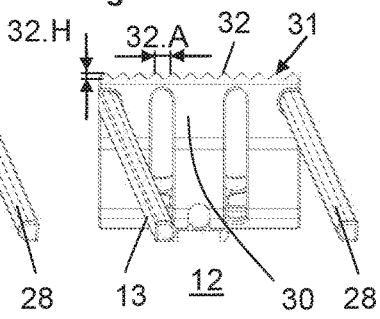

WASHING ITEM RECEPTACLE FOR A FLAT WASHING ITEM IN A DISHWASHER

CROSS-REFERENCES TO RELATED APPLICATIONS

This application is the U.S. National Stage of International Application No. PCT/EP2016/073901, filed Oct. 6, 2016, which designated the United States and has been published as International Publication No. WO 2017/060365 A1 and which claims the priority of German Patent Application, Serial No. 10 2015 219 620.8, filed Oct. 9, 2015, pursuant to 35 U.S.C. 119(a)-(d).

BACKGROUND OF THE INVENTION

The present invention relates to a washing item receptacle for a flat washing item in a dishwasher, in particular in a domestic dishwasher.

It is known to provide a washing item receptacle for a flat washing item in a dishwasher, which comprises a plurality of vertical support elements for the flat washing item which project rigidly from the base of the washing item receptacle.

Furthermore, washing item receptacles for a flat washing item in a dishwasher are known, the vertical support elements of which projecting from the base of the washing item receptacle can be manually moved into the base of the washing item receptacle. For reasons of ease of use, here a plurality of support elements is combined in each case to form a comb-shaped unit, which can only be folded down as a whole. Examples of this can be found in the publication U.S. Pat. No. 5,601,195 and the publication WO 00/49935 A1. Before introducing a flat washing item a moved comb-shaped unit is therefore to be manually raised from the base of the washing item receptacle into a vertical support position.

In the vertical support position, all support units of a washing item receptacle or a comb-shaped unit therefore project into the space above the base of the washing item receptacle, even when only partially loaded with flat washing items. Loading the washing item receptacle with washing items of another shape is hindered as a result.

BRIEF SUMMARY OF THE INVENTION

Against this background an object of the present invention consists in providing an improved washing item receptacle for a flat washing item in a dishwasher.

Accordingly, a washing item receptacle for a flat washing item in a dishwasher, in particular in a domestic dishwasher, is proposed with a base and at least one support element for supporting the flat washing item. The at least one support element is configured to be pivoted between a rest position arranged in a plane of the base and a support position which projects from the plane of the base. Here the at least one support element can be pivoted from the rest position into the support position by the weight of the flat washing item.

Contrary to conventional washing item receptacles with support elements assembled in a rigid or comb-shaped manner, the at least one support element of the proposed washing item receptacle is raised individually and automatically, as needed, in other words when it is loaded with flat washing items. It fulfills its support function wherever the at least one support element is required, whereas it does not interfere wherever it is currently not required, and thus keeps storage surfaces free for washing items of a different shape such as, for instance, cups, bowls, pans etc.

The washing item receptacle may have a mesh basket encased with plastic, for instance, in which, where appropriate, various support elements for various types of washing item can also be provided. In particular, the washing item receptacle can comprise a lower basket, an upper basket or a cutlery drawer.

A flat washing item is a washing item, the size of which in a third dimension is very much smaller than its size in the other two dimensions.

A dishwasher may in particular be a domestic dishwasher.

According to one embodiment, the at least one support element is pivotably hinged in the base. In other words, a pivot axis of the at least one support element lies in the plane of the base.

Contrary to conventional washing item receptacles, the at least one support element is preferably individually pivotably hinged in the base of the washing item receptacle.

According to a further embodiment, the at least one support element is pivotably hinged in the base by means of a pin-bush joint.

The pivot axis of the support element corresponds here to the axis of rotation of the pin-bush joint.

According to a further embodiment, the at least one support element has a recess, which can be snapped open in order to pivotably hinge the at least one support element on a cylindrical rod element of the base.

Alternatively to a pin-bush joint, the at least one support element can likewise be pivotably hinged in the base of the washing item receptacle by means of a joint which passes through the at least one support element, for instance consisting of a recess and a cylindrical rod element of the base.

Here a cylindrical rod element can be a straight wire element, for instance, in the base of a washing item receptacle embodied as a mesh basket.

The pivot axis of the at least one support element corresponds to the axis of rotation of the joint, in other words the rotational axis of symmetry of the recess in the at least one support element.

According to a further embodiment, the at least one support element has a lever extension, which, when the flat washing item is introduced, is configured to pivot the at least one support element from the rest position into the support position by its weight.

The lever extension is preferably embodied such that it receives the weight of the flat washing item when it is introduced. For instance, it can move vertically downward in this process. This causes a torque to form around the pivot axis of the at least one support element, which raises the at least one support element.

Furthermore, with respect to the pivot axis the lever extension is preferably provided on any side of the at least one support element, which faces the center of gravity of the at least one support element.

According to a further embodiment, the washing item receptacle is characterized by a return spring for returning the at least one support element from the support position into the rest position when the flat washing item is removed.

As a result, the pivot axis of the at least one support element can be provided close to or in its center of gravity.

According to a further embodiment, the at least one support element is configured to move back out of the support position into the rest position when the flat washing item is removed, as a result of an empty weight of the support element.

Here the pivot axis of the at least one support element is preferably arranged outside of its center of gravity such that the at least one support element is unbalanced when the flat washing item is removed and it is forced to adopt its rest position according to the weight.

According to a further embodiment, the at least one support element has a stop, which is configured to fix the rest position of the at least one support element.

The stop is preferably embodied as a projection on the at least one support element, which, in the rest position, rests against a rod element of the base of the washing item receptacle and prevents the at least one support element from pivoting out beyond its rest position.

Alternatively, the at least one support element can itself also come to rest against a rod element of the base of the washing item receptacle and as a result form a stop.

According to a further embodiment, the washing item receptacle is characterized by at least one bracing element for bracing an edge, close to the base, of the flat washing item.

By means of the at least one bracing element, the edge, close to the base, of the flat washing item and therefore also the flat washing item as a whole is secured against slipping in particular in the horizontal direction of the base of the washing item receptacle.

According to a further embodiment, the at least one bracing element is an element of the base.

A rod element of the base of the washing item receptacle, which is already provided for design purposes here, for instance a wire encased with plastic, preferably forms the at least one bracing element.

According to a further embodiment, the at least one bracing element is a hook extension of the at least one support element, which is configured to grip the edge of the flat washing item which rests on the base, in the support position.

Here the lever extension of the at least one support element is preferably continued in the shape of a hook such that it grips the edge of the flat washing item which rests on the base or on the lever extension.

According to a further embodiment, the flat washing item is a plate.

A plate is in most cases round and planar, in other words a flat washing item.

On account of its curvature in the base of the washing item receptacle, an edge of the plate can lie vertically lower than the contact points of the plate on the base or the lever extensions.

The lever extension of the at least one support element is therefore preferably provided such that when the plate is introduced it is actuated on account of this change in position. For instance, the lever extension of the at least one support element can, as a result, be pivoted into or below the base of the washing item receptacle.

Furthermore, the at least one bracing element, where it is an element of the base, can as a result be embodied preferably as a straight rod element, which is flush with the base of the washing item receptacle.

According to a further embodiment, the washing item receptacle comprises at least one additional support element, wherein the at least two support elements are configured to receive the plate's depression therebetween or thereupon when the plate is introduced.

The support element and the immediately adjacent and additional support element can be connected to one another by means of their respective lever extension when forming a connecting web. The connecting web can, if the support element and the immediately adjacent and additional support element are in the rest state, in other words are folded in around its pivot axis, be provided at least at the top with a contoured surface, which may be variable in terms of shape and/or size. The contoured surface can be formed of teeth here, for instance, wherein the shape of the teeth may in turn be designed to be wavelike, triangular or semicircular. The teeth may have a respective height of 0.5 to 2 mm, preferably of 0.8 to 1.5 mm, in particular of 1 mm and a respective gap of 1 to 3 mm, preferably of 1.2 to 2 mm, in particular of 1.5 mm. The teeth securely receive glasses and other vertical dishes in the rest state, in other words when the support elements are folded in, and provide these with a better hold. They are held by the depressions between the teeth and secured against slipping.

An additional support element per plate can increase the positional stability of the respective plate in the washing item receptacle.

In such cases the at least two support elements are preferably provided symmetrically with respect to the vertical central axis of a plate, received in the washing item receptacle, in the base of the washing item receptacle.

Both a counter-rotating and also a co-rotating pivoting of the at least two support elements when the respective plate is introduced is conceivable, wherein the counter-rotating pivoting is preferable on account of a plate symmetry. Depending on the design of the plate, the at least two support elements either rest against the edge of the plate or against its depression, when pivoting in a counter-rotating manner.

According to a further embodiment, the at least one support element is embodied to be flat or rod-shaped.

For instance, a flat support element can be embodied using injection molding, wherein if necessary an insert part which serves as reinforcement can be extrusion-coated. Alternatively, rod-shaped support elements are conceivable, which in structural terms correspond to the rod elements of the base of the washing item receptacle.

According to a further embodiment, the support element is embodied in plastic and/or metal.

Further possible implementations of the invention also comprise combinations—not explicitly cited—of features or forms of embodiment described above or below in respect of the exemplary embodiments. Here the person skilled in the art will also add individual aspects as improvements or amendments to the respective basic form of the invention.

BRIEF DESCRIPTION OF THE DRAWINGS

Further advantageous embodiments and aspects of the invention are the subject matter of the dependent claims as well as the exemplary embodiments of the invention described below. The invention is also described in greater detail below on the basis of preferred forms of embodiment with reference to the attached figures, in which

FIG. 10 shows a perspective view of a further embodiment of a support element and an immediately adjacent and additional support element of a washing item receptacle;

FIG. 11 shows a further perspective view of the two support elements from FIG. 10;

FIG. 12 shows a front view of the two support elements from FIG. 10;

FIG. 13 shows a side view of the two support elements from FIG. 10;

FIG. 14*a* shows a front view of a first embodiment of a connecting web between a support element and an immediately adjacent and additional support element of a washing item receptacle;

FIG. 14*b* shows a front view of a second embodiment of a connecting web between a support element and an immediately adjacent and additional support element of a washing item receptacle;

FIG. 14*c* shows a front view of a third embodiment of a connecting web between a support element and an immediately adjacent and additional support element of a washing item receptacle;

DETAILED DESCRIPTION OF EXEMPLARY EMBODIMENTS OF THE PRESENT INVENTION

Figure 1:
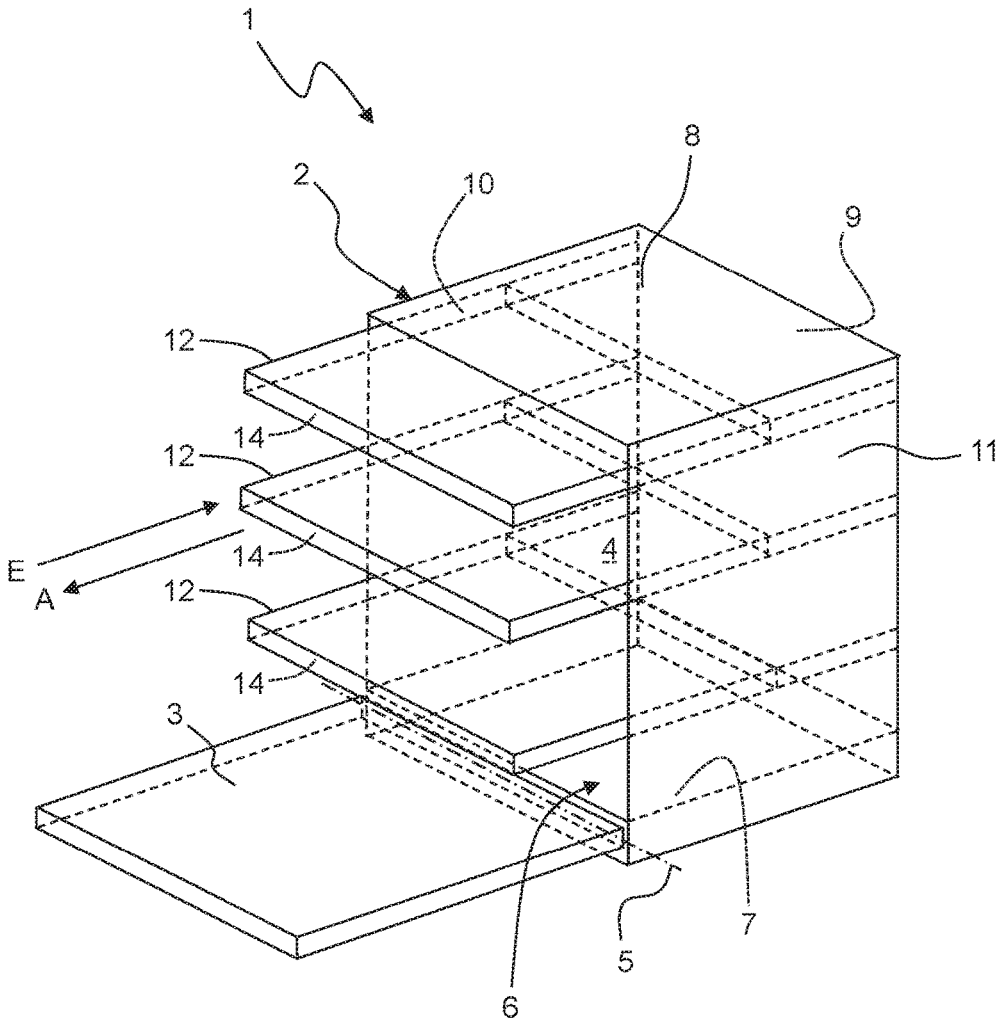
FIG. 1 shows a perspective view of an embodiment of a dishwasher.

Elements which are the same or function the same have been provided with the same reference characters in the figures, unless specified otherwise.

FIG. 1 shows a perspective view of a dishwasher 1, in particular a domestic dishwasher. The dishwasher 1 has a dishwasher cavity 2, which can be closed, in particular in a water-tight manner, by a door 3. To this end a sealing facility can be provided between the door 3 and the dishwasher cavity 2. The dishwasher cavity 2 is preferably rectangular. In particular, the dishwasher cavity 2 can be manufactured from steel sheet. Alternatively, the dishwasher cavity 2 can be manufactured at least in sections from a plastic material. The dishwasher cavity 2 and the door 3 can form a washing chamber 4 for washing items to be washed. The dishwasher cavity 2 is arranged in the interior of a housing of the dishwasher 1. The door 3 is shown in its open position in FIG. 1. The door 3 can be closed or opened by pivoting about a pivot axis 5 provided at a lower end of the door 3.

The dishwasher cavity 2 has a container wall 6 with a base 7, a ceiling 8 arranged opposite to the base 7, a rear wall 9 arranged opposite to the door 3, and two side walls 10, 11 arranged opposite to one another. The base 7, the ceiling 8, the rear wall 9 and the side walls 10, 11 can be manufactured from stainless steel sheet, for instance. Alternatively, the base 7 can be manufactured from a plastic material for instance.

The dishwasher 1 also has at least one washing item receptacle 12. In particular, a number of washing item receptacles 12 can be provided, wherein in each case one of the number of washing item receptacles 12 is a lower basket, an upper basket or a cutlery drawer in the dishwasher 1. The number of washing item receptacles 12 are preferably arranged one above the other in the dishwasher cavity 2. Each washing item receptacle 12 can optionally be moved in or out of the dishwasher cavity 2. In particular, each washing item receptacle 12 can be moved into the dishwasher cavity 2 in an insertion direction E and can be removed from the dishwasher cavity 2 counter to the insertion direction E in an extraction direction A.

Figure 2:
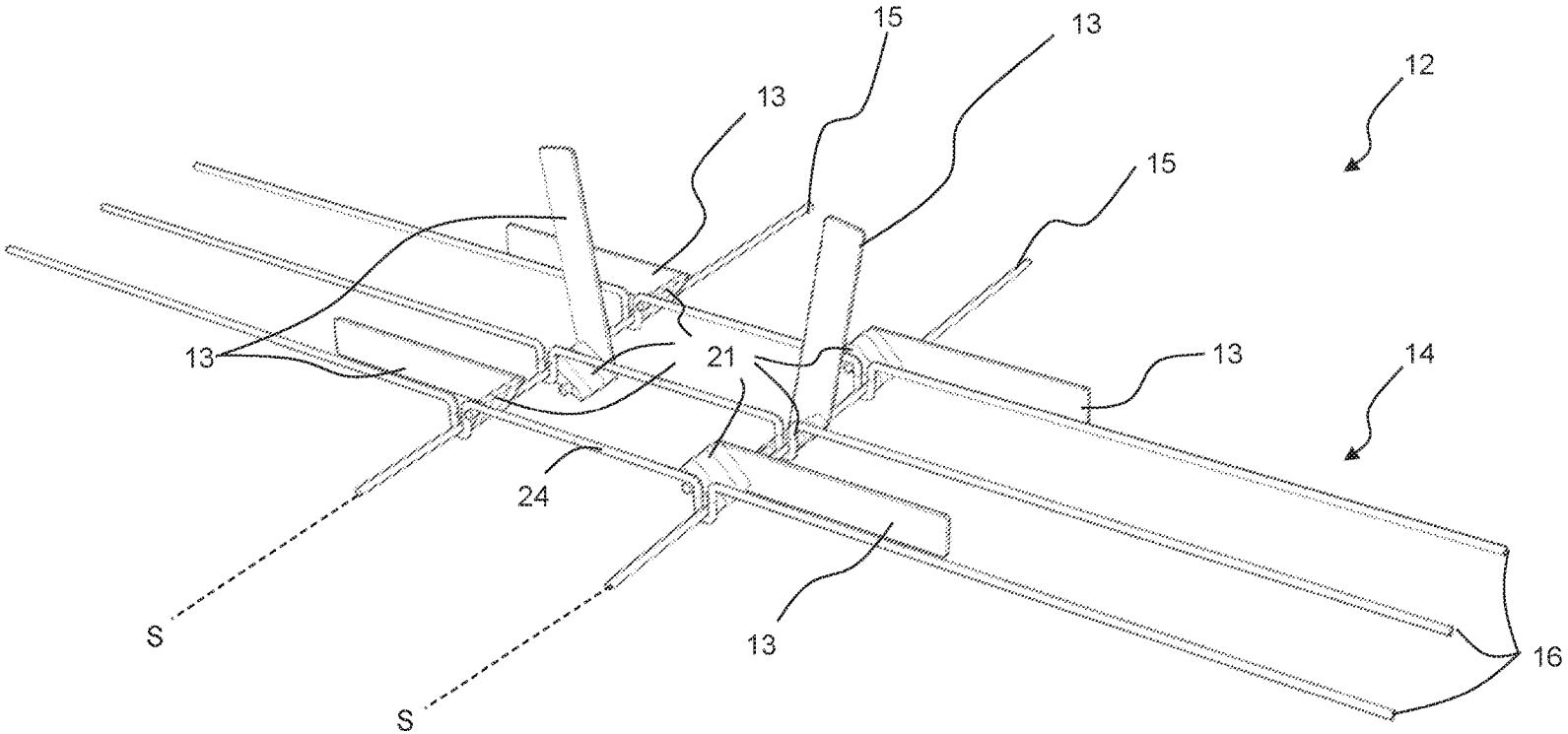
FIG. 2 shows a perspective detailed view of an embodiment of a washing item receptacle, with support elements arranged in various positions so as to counter rotate.

FIG. 2 shows a perspective detailed view of an embodiment of a washing item receptacle 12 with support elements 13 arranged in various positions to counter rotate.

This figure shows a cutout from the base 14 of the washing item receptacle 12, which is formed from several rod elements 15, 16 which are arranged in parallel or at right angles to one another.

Figure 5:
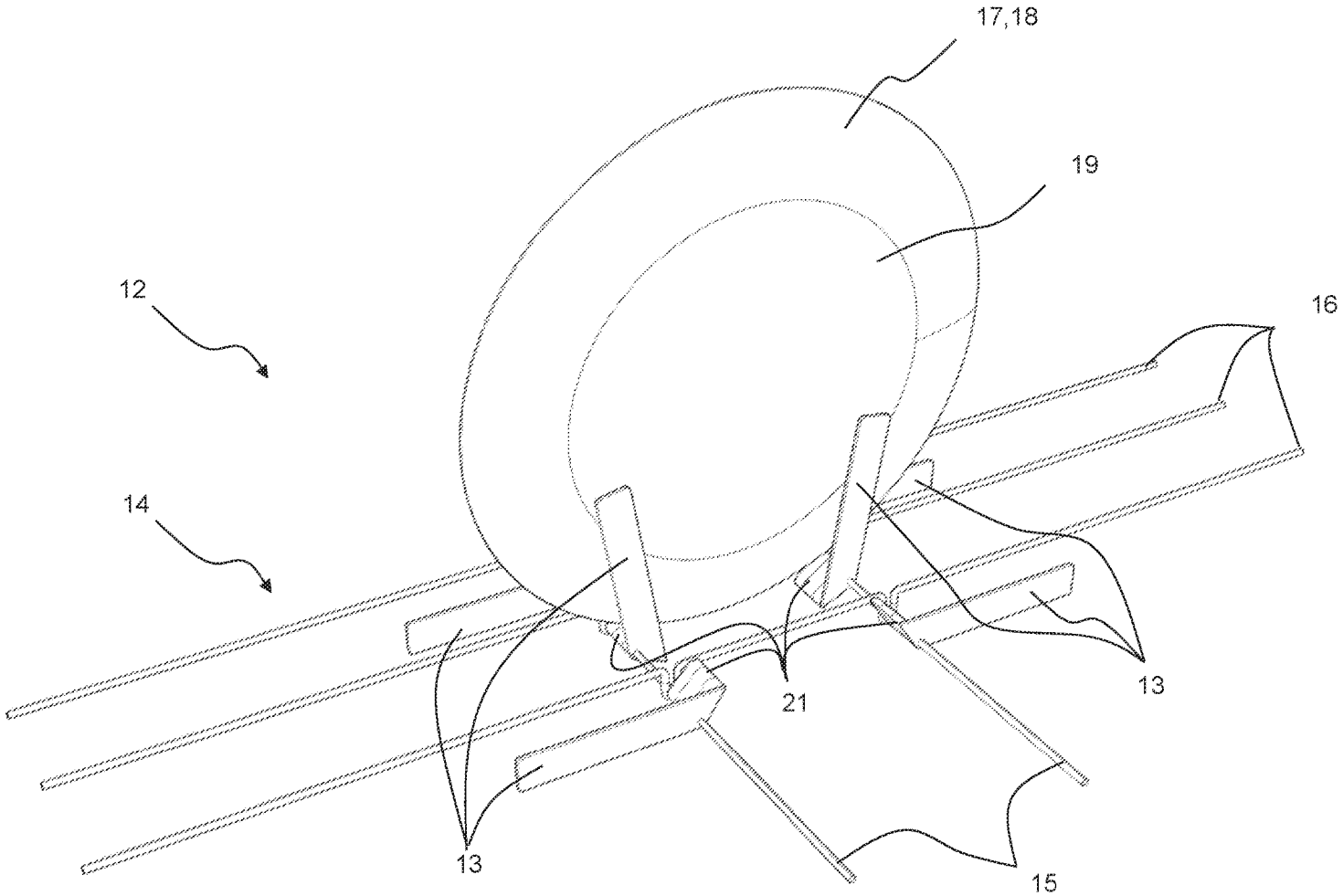
FIG. 5 shows the perspective detailed view from FIG. 2 with the plate in the rear view.

A number of pairs of support elements 13 arranged to counter rotate are shown in various positions. When a flat washing item 17, in particular a plate 18, is introduced, each of these pairs is configured to receive its depression 19 therebetween or thereupon, as shown in FIG. 5.

The two outer pairs of counter-rotating support elements 13 are disposed in a rest position in a plane of the base 14, the middle pair by contrast is disposed in a support position which projects from the plane of the base 14.

Figure 3:
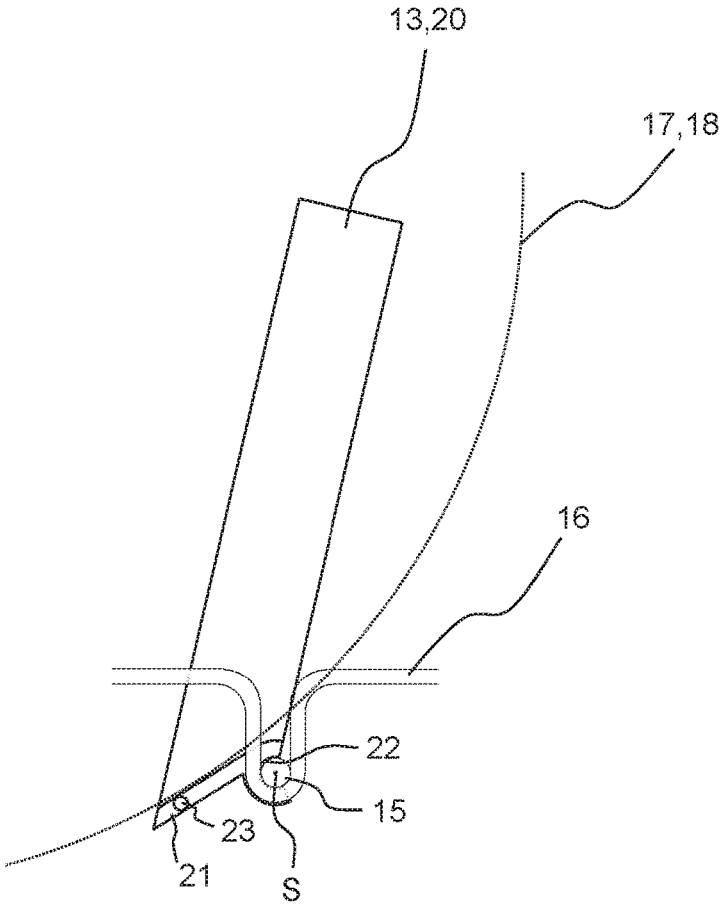
FIG. 3 shows a detailed view of the embodiment from FIG. 2 with a snapped-open support element in the support position.

FIG. 3 shows a detailed view of the embodiment from FIG. 2 with a snapped-open support element 13 in the support position.

A rod element 15 of the base 14 is fixed in a U-shaped depression of a rod element 16, which is at right angles to the rod element 15 in the plane of the base 14.

Furthermore, a support element 13 is shown, which has a base body 20 in the form of a rectangular disk, for instance. The base body 20 can consist of plastic, for instance, and is embodied at its one end in one piece with a lever extension 21.

The lever extension 21 is configured to pivot the support element 13 about a pivot axis S of the support element 13 from a rest position into a support position by its weight when a flat washing item 17 is introduced.

The pivot axis S of the support element 13 is identical here to the longitudinal axis of the rod element 15, on which the support element 13 with a recess 22 provided herefor is snapped open.

The support element 13 is moreover configured to move back out of the support position into the rest position on account of an empty weight when the flat washing item 17 is removed.

The rest position of the support element 13 is fixed here by a stop 23 which is embodied on the lever projection 21 and rests against the rod element 16 in the rest position.

Figure 4:
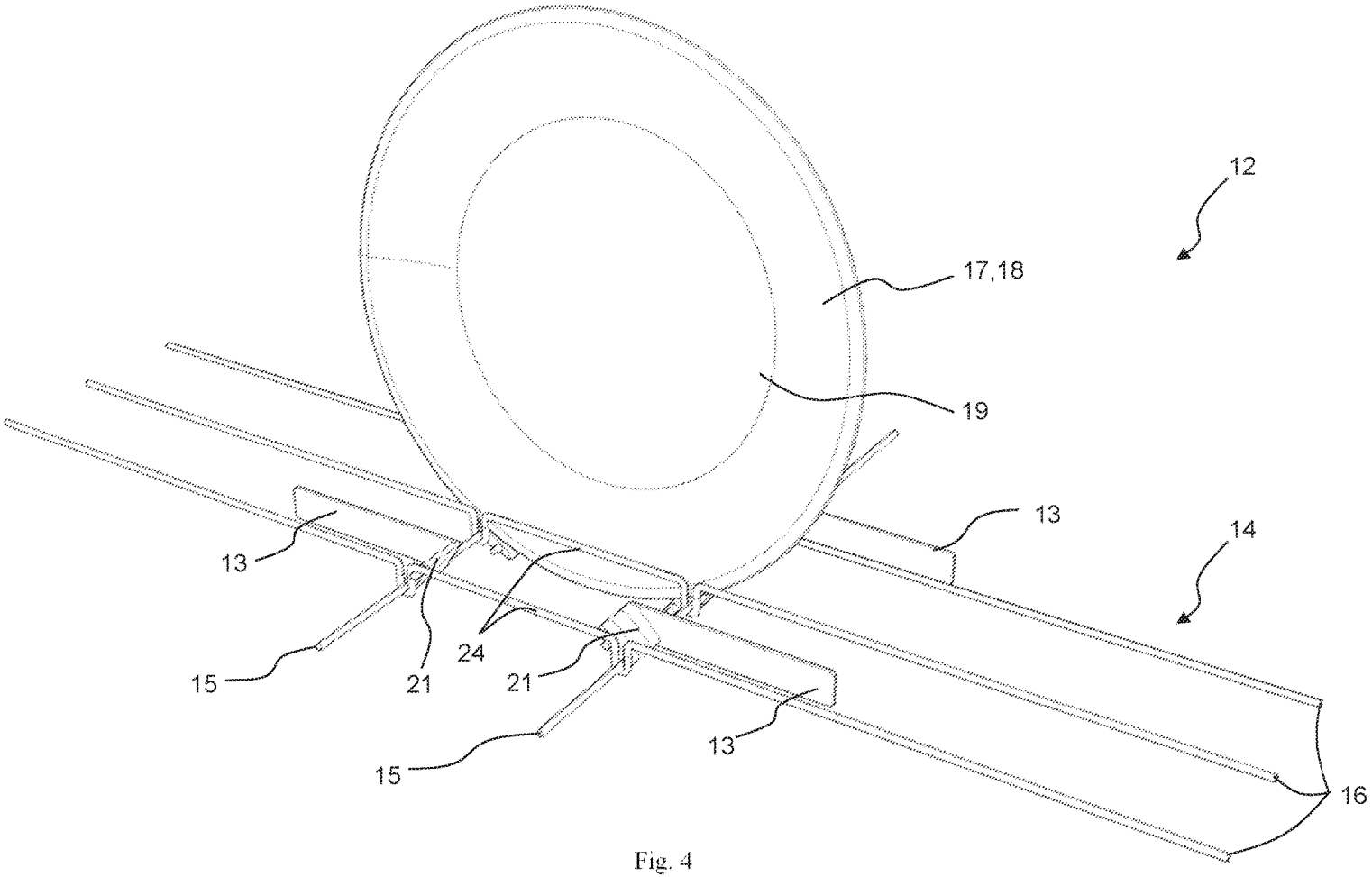
FIG. 4 shows the perspective detailed view from FIG. 2 with a plate in the front view.

FIG. 4 shows the perspective detailed view from FIG. 3 with a plate 18 in the front view.

Contrary to FIG. 3, the plate 18 is introduced into the washing item receptacle 12 in FIG. 4, the base of which 14 is shown in cross-sections. The two support elements 13 of the middle pair of counter-rotating support elements 13 are pivoted in a counter-rotating manner into their support position on account of the weight of the plate 18, which acts on the lever extensions 21 of the middle pair.

As shown clearly in FIG. 4, one section of a respective rod element 16 of the base 14 serves as a bracing element 24 for bracing an edge, which is close to the base, of the plate 18. The bracing element 24 prevents the plate 18 from slipping on the base 14 of the washing item receptacle 12, particularly in the horizontal direction.

FIG. 5 shows the perspective detailed view from FIG. 4 with a plate 18 in the rear view.

It can be seen from FIG. 5 that by means of the counter-rotating raised support elements 13, the plate 18 is not able to tilt out of its vertical position onto the base 14 of the washing item receptacle 12, shown in cross-section, since they receive the plate's depression 19 therebetween or thereupon depending on the plate's geometry. Here, the support elements 13 are resting against the depression 19.

Figure 6:
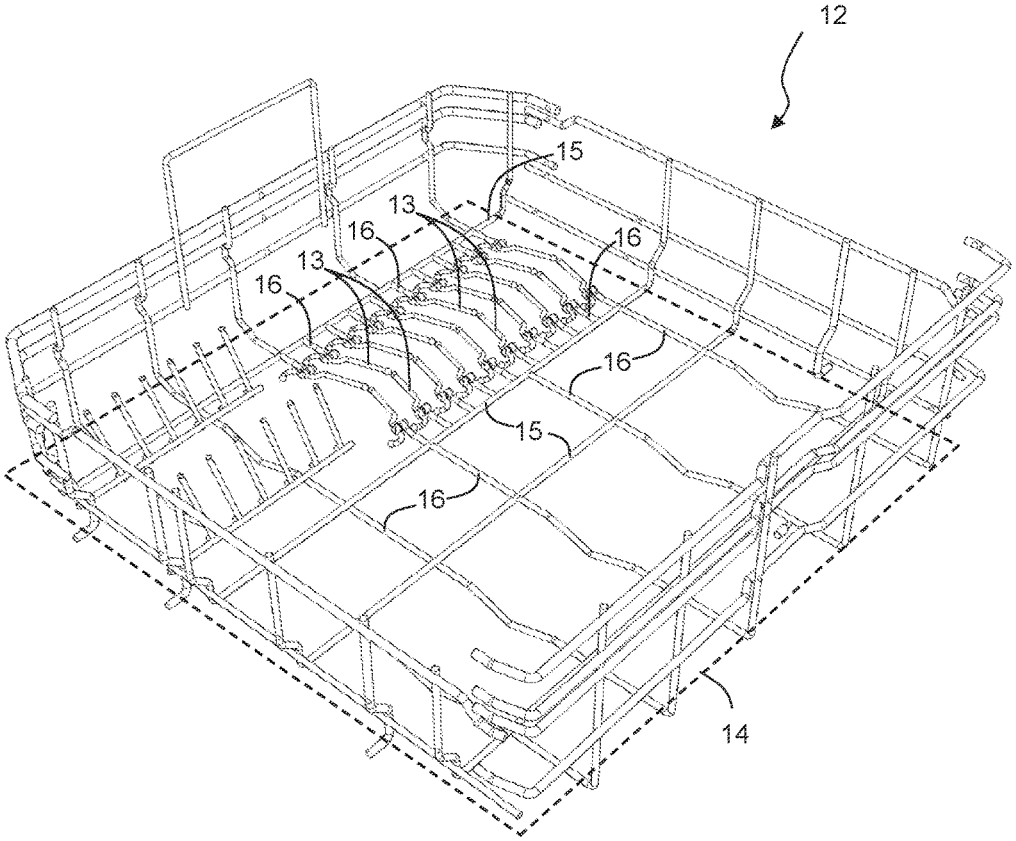
FIG. 6 shows a perspective view of a further embodiment of a washing item receptacle with a number of support elements in the rest position.

FIG. 6 shows a perspective view of a further embodiment of a washing item receptacle 12 with a number of support elements 13 in the rest position.

The washing item receptacle 12 is embodied as a lower basket, the base 14 of which consists of rod elements 15, 16 and provides a plurality of support elements 13 in pairs such that support elements 13 oppose one another in pairs and pivot in a counter-rotating manner into the support position when a plate 18 is introduced. A plurality of plates 18 can thus be arranged in a row one behind the other in the washing item receptacle 12.

Figure 7:
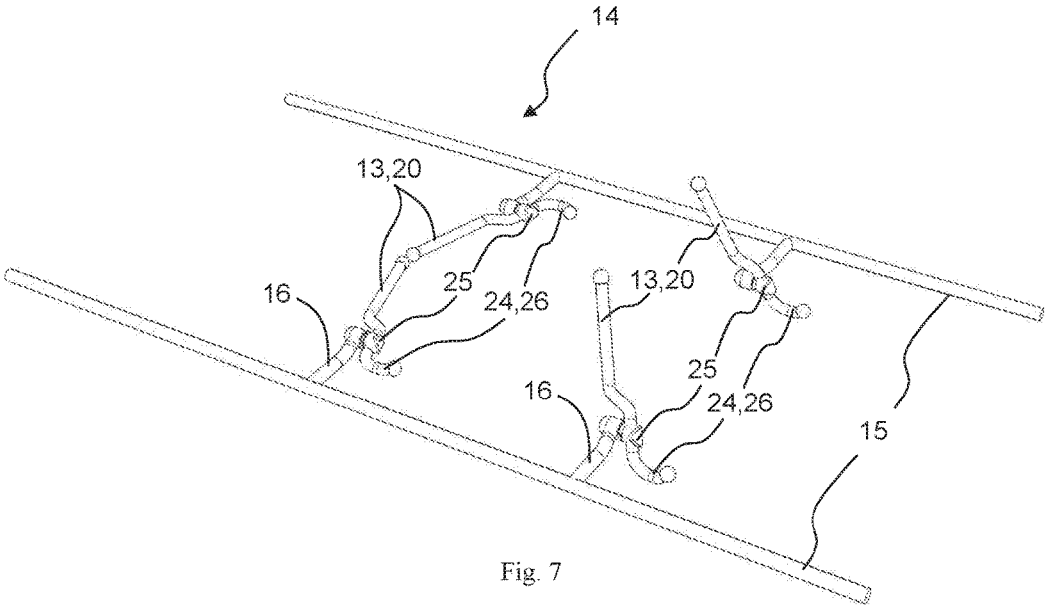
FIG. 7 shows the perspective detailed view of the embodiment from FIG. 6 with support elements in various positions.

FIG. 7 shows the perspective detailed view of the embodiment from FIG. 6 with support elements 13 in various positions.

Here two parallel rod elements 15 form the section of the base 14 of the washing item receptacle 12, to which the support elements 13 are each pivotably hinged in the base 14 by way of a stub of a rod element 16 and a pin-bush joint arranged at one end of the same.

In the embodiment shown, the support elements 13 have a base body 20 embodied in particular from wire, with a dual angled design, to which a hook extension 26 connects. In the support position the hook extension 26 is configured to grip the edge of the plate 18 which rests on the base 14 and accordingly serves as a bracing element 24.

Figure 8:
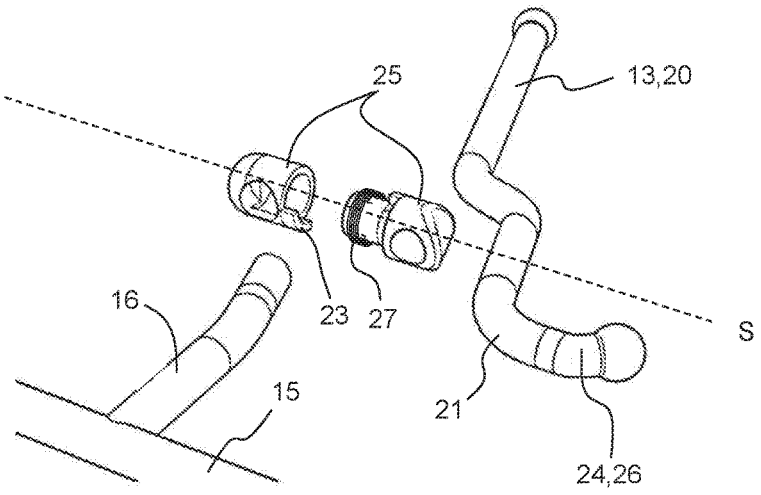
FIG. 8 shows the perspective view of a support element of the embodiment from FIG. 6 in an exploded view.

FIG. 8 shows the perspective view of a support element 13 of the embodiment from FIG. 6 in an exploded view.

The right side in FIG. 8 represents the dual angled support element 13 with its hook extension 26 which serves as a bracing element 24. The arrangement in rows along the pivot axis S indicates that the support element 13 is pivotably hinged to the stub of a rod element 16 of the base 14 by way of a two-part pin-bush joint 25. A stop 23 provided on the bush of the joint 25 fixes the rest position of the support element 13. Internally the joint 25 can comprise a return spring 27 embodied as a torsion spring, for instance, which supports the return of the support element 13 into the rest position.

Figure 9:
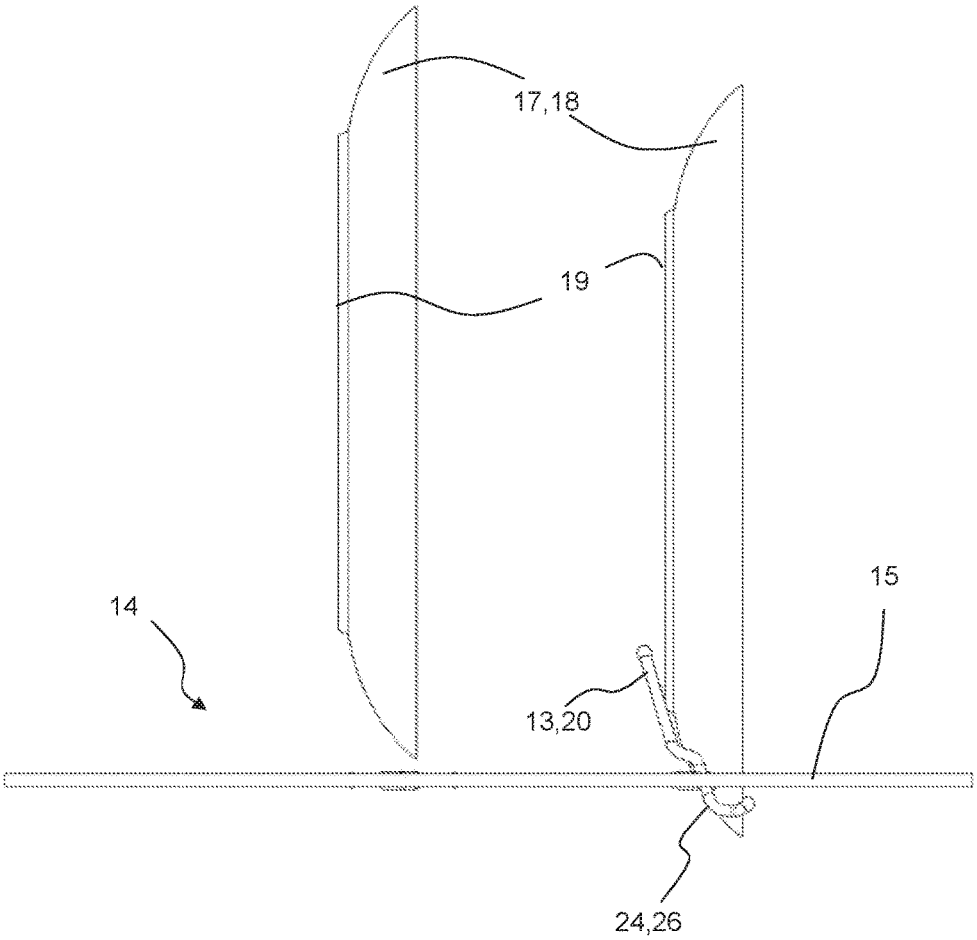
FIG. 9 shows a side view of the embodiment from FIG. 6 with support elements in various positions and with the plate.

FIG. 9 shows a side view of the embodiment from FIG. 6 with a support element 13 in various positions, and the plate 18. In the rest position shown to the left, the support element 13 is flush with the base 14, whereas in the support position shown to the right, it projects from the base 14.

FIG. 10 shows a perspective view of a further embodiment of a support element 13 and an immediately adjacent and additional support element 28 of a washing item receptacle 12.

The support element 13 and the immediately adjacent and additional support element 28 of the washing item receptacle 12 are connected to one another by means of their respective lever extension 21, 29 forming a connecting web 30. When the support element 13 and the immediately adjacent and additional support element 28 are in the rest state, in other words are folded in about its pivot axis S (merely indicated), the connecting web 30 is provided at least at the top with a contoured surface 31, which may be variable in terms of shape and/or size.

FIG. 11 shows a further perspective view of the two support elements 13, 28 of the washing item receptacle 12 from FIG. 10.

It is clear that the contoured surface 31, which may be variable in terms of shape and/or size, is visible on the connecting web 30 between the lever extensions 21, 29 of the two support elements 13, 28.

FIG. 12 shows a front view of the two support elements 13, 28 of the washing item receptacle 12 from FIG. 10.

Also in this front view of the two support elements 13, 28, the contoured surface 31, which may be variable in terms of shape and/or size, is visible on the connecting web 30 between the lever extensions 21, 29 of the two support elements 13, 28.

FIG. 13 finally shows a side view of the two support elements 13, 28 of the washing item receptacle 12 from FIG. 10, wherein the additional support element 28 is concealed by the support element 13.

The contoured surface 31, which may be variable in terms of shape and/or size, is in turn visible on the connecting web 30 between the lever extensions 21, 29 of the two support elements 13, 28.

FIG. 14*a* shows a front view of a first embodiment of a connecting web 30 between a support element 13 and an immediately adjacent and additional support element 28 of a washing item receptacle 12.

When the support element 13 and the immediately adjacent and additional support element 28 are in the rest state, in other words folded in about its pivot axis (not shown), the connecting web 30 is provided at least at the top with a contoured surface 31, which may be variable in terms of shape and/or size. The contoured surface 31 is formed of teeth 32, which are designed to be triangular, and which have a respective height 32.H of 0.5 to 2 mm, preferably of 0.8 to 1.5 mm, in particular of 1 mm and a respective gap 32.A of 1 to 3 mm, preferably of 1.2 to 2 mm, in particular of 1.5 mm.

FIG. 14*b* shows a front view of a second embodiment of a connecting web 30 between a support element 13 and an immediately adjacent and additional support element 28 of a washing item receptacle 12.

When the support element 13 and the immediately adjacent and additional support element 28 are in the rest state, in other words folded in about its pivot axis (not shown), the connecting web 30 is provided at least at the top with a contoured surface 31, which may be variable in terms of shape and/or size. The contoured surface 31, as in the first embodiment in FIG. 14*a*, is formed of teeth 32, which are designed to be semicircular, and which have a respective height 32.H of 0.5 to 2 mm, preferably of 0.8 to 1.5 mm, in particular of 1 mm and a respective gap 32.A of 1 to 3 mm, preferably of 1.2 to 2 mm, in particular of 1.5 mm.

FIG. 14*c* shows a front view of a third embodiment of a connecting web between a support element 13 and an immediately adjacent and additional support element 28 of a washing item receptacle 12.

When the support element 13 and the immediately adjacent and additional support element 28 are in the rest state, in other words folded in about its pivot axis (not shown), the connecting web 30 is provided at least at the top with a contoured surface 31, which may be variable in terms of shape and/or size. The contoured surface 31 is, as in the first two embodiments in FIG. 14*a* and FIG. 14*b*, formed of teeth 32, which are designed to be wavelike, and which have a height 32.H of 0.5 to 2 mm, preferably of 0.8 to 1.5 mm, in particular of 1 mm and a respective gap 32.A of 1 to 3 mm, preferably of 1.2 to 2 mm, in particular of 1.5 mm.

Figure 15:
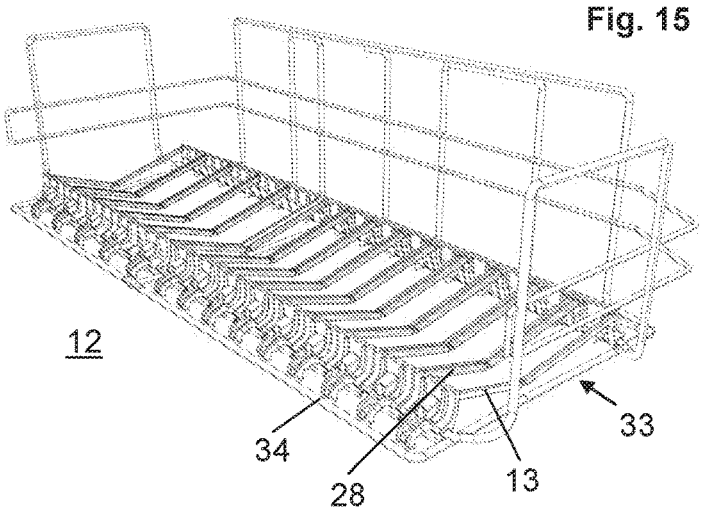
FIG. 15 shows a perspective view of a further embodiment of a washing item receptacle.

FIG. 15 shows a perspective view of a further embodiment of a washing item receptacle 12.

The washing item receptacle 12 is embodied as a preferably removable insert 33 for a lower basket, the base 34 of which provides a plurality of individual support elements 13 and in each case immediately adjacent and additional support elements 28. The respectively connected support elements 13, 28 are arranged in rows of pairs, such that corresponding support elements 13, 28 oppose one another in pairs and pivot in a counter-rotating manner into the support position when a plate or a similar washing item is introduced. A plurality of plates or similar washing items can thus be arranged in a row one behind the other in the washing item receptacle 12.

Figure 16:
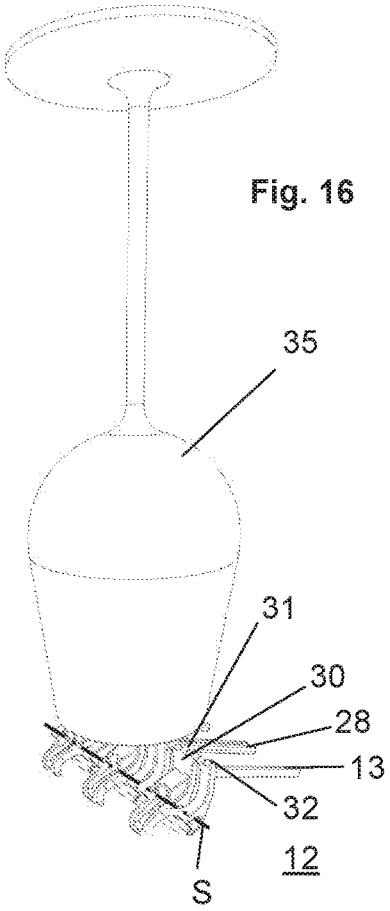
FIG. 16 shows a perspective view of a further embodiment of a washing item receptacle with a wine glass positioned in the rest position.

FIG. 16 shows a perspective view of a further embodiment of a washing item receptacle 12 with a wine glass 35 positioned in the rest position.

The washing item receptacle comprises support elements 13 and immediately adjacent and additional support elements 28, which are connected to one another by means of their respective lever extension 21, 29 forming a connecting web 30. When the support element 13 and the immediately adjacent and additional support element 28 are in the rest state, in other words folded in about their pivot axis S (merely indicated), the connecting web 30 is provided at least at the top with a contoured surface 31, which may be variable in terms of shape and/or size. The contoured surface 31 is formed of teeth 32, which securely receive the wine glass 35 in the rest state, in other words in the folded-in state of the support elements 13, 28, and provide this with a better hold. It is held by the depressions between the teeth 32 and secured against slipping.

Figure 17:
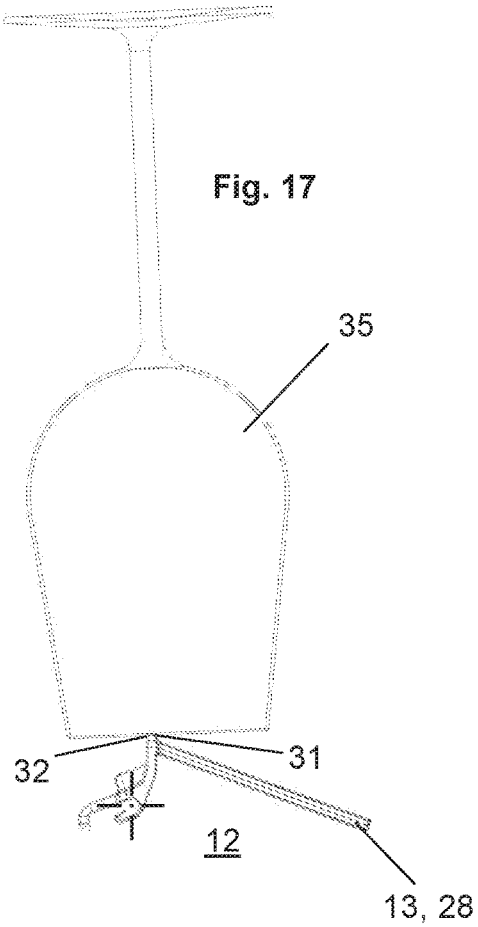
FIG. 17 shows a side view of the further embodiment of a washing item receptacle with a wine glass positioned in the rest position from FIG. 16.

FIG. 17 shows a side view of the further embodiment of a washing item receptacle 12 with a wine glass positioned in the rest position from FIG. 16.

The contoured surface 31 formed of teeth 32 securely receives the wine glass 35 in the rest state, in other words in the folded-in state of the support elements 13, 28, and provides this with a better hold. It is held by the depressions between the teeth 32 and secured against slipping.

Although the present invention has been described on the basis of exemplary embodiments, it can be modified in a variety of ways.

The invention claimed is:

1. A dishwasher washing item receptacle in combination with a dishwasher having a dishwasher cavity, said dishwasher washing item receptacle being shaped to accommodate at least one flat washing item therein, the at least one flat washing item including at least a plate, said dishwasher washing item receptacle being disposed for movement in and out of the dishwasher cavity, said dishwasher washing item receptacle comprising:

a base; and at least a pair of support elements for supporting the flat washing item, each support element of said pair of support elements being configured to pivot between a rest position arranged in a plane of the base and a support position which projects from the plane of the base, and said pair of support elements being configured to pivot from the rest position into the support position by a weight of the flat washing item thereby to support the flat washing item.

2. The dishwasher washing item receptacle of claim 1, wherein each of the support elements is pivotably hinged in the base.

3. The dishwasher washing item receptacle of claim 1, wherein each of the support elements is pivotably hinged in the base by a pin-bush joint.

4. The dishwasher washing item receptacle of claim 1, wherein the base has a cylindrical rod element, each of said support elements having a recess configured for snapping onto the cylindrical rod element of the base to pivotably hinge a corresponding support element.

5. The dishwasher washing item receptacle of claim 4, wherein each of the support elements has a lever extension, which is configured to pivot a corresponding support element from the rest position into the support position by the weight of the flat washing item when the flat washing item is introduced.

6. The dishwasher washing item receptacle of claim 1, further comprising a return spring for returning a corresponding support element from the support position into the rest position when the flat washing item is removed.

7. The dishwasher washing item receptacle of claim 1, wherein the pair of support elements is configured to return from the support position into the rest position by a weight of each of the support elements, when the flat washing item is removed.

8. The dishwasher washing item receptacle of claim 1, wherein each support element has a stop to fix the rest position of the support element.

9. The dishwasher washing item receptacle of claim 1, further comprising a bracing element for bracing a base-proximal edge of the flat washing item.

10. The dishwasher washing item receptacle of claim 9, wherein the bracing element is an element of the base.

11. The dishwasher washing item receptacle of claim 9, wherein the bracing element is a hook extension of a corresponding support element, said hook extension being configured to grip the edge of the flat washing item, when the edge rests on the base in the support position.

12. The dishwasher washing item receptacle of claim 1, further comprising an additional support element, the pair of support elements and the additional support element together receiving the plate therebetween or thereupon, when the plate is introduced.

13. The dishwasher washing item receptacle of claim 1, wherein each support element is one of flat or rod-shaped.

14. The dishwasher washing item receptacle of claim 1, wherein each support element is made of at least one of plastic or metal.

15. The dishwasher washing item receptacle of claim 1, wherein the dishwasher comprises a domestic dishwasher.

* * * * *